US005597637A

United States Patent [19]

Abrams et al.

[11] Patent Number: 5,597,637

[45] Date of Patent: Jan. 28, 1997

[54] ELASTOMERIC BACKING FOR FLOCK TRANSFER

[75] Inventors: Louis B. Abrams, Fort Collins; William J. Anderson, Loveland, both of Colo.

[73] Assignee: High Voltage Graphics, Inc., Fort Collins, Colo.

[21] Appl. No.: 301,080

[22] Filed: Sep. 6, 1994

[51] Int. Cl.[6] ..... B05D 1/14; B05D 1/6; D05C 17/00; B05B 5/02

[52] U.S. Cl. ..... 428/90; 428/95; 428/97

[58] Field of Search ..... 428/90, 97, 95

[56] References Cited

U.S. PATENT DOCUMENTS

| | | | |
|---|---|---|---|
| 4,142,929 | 3/1979 | Otomine et al. | 428/90 |
| 4,201,810 | 5/1980 | Higashiguchi | 428/90 |
| 4,269,885 | 5/1981 | Mahn . | |
| 4,282,278 | 8/1981 | Higashiguchi | 428/90 |
| 4,292,100 | 9/1981 | Higashiguchi | 428/90 |
| 4,405,401 | 9/1983 | Stahl . | |
| 4,423,106 | 12/1983 | Mahn . | |
| 4,810,549 | 3/1989 | Abrams et al. . | |
| 5,047,103 | 9/1991 | Abrams et al. | 428/90 |

FOREIGN PATENT DOCUMENTS

| | | | |
|---|---|---|---|
| 0210304 | 4/1987 | European Pat. Off. | 428/90 |

*Primary Examiner*—Terrel Morris
*Attorney, Agent, or Firm*—Paul M. Denk

[57] ABSTRACT

A stretchable hot melt is applied to a transfer so that the transfer may stretch when it is applied to a stretchable substrate without cracking or splitting. The hot melt is made from an extrusion of polyester and urethane combined in a ratio of between 80:20 and 20:80.

2 Claims, 1 Drawing Sheet

ELASTOMERIC BACKING FOR FLOCK TRANSFER

BACKGROUND OF THE INVENTION

This invention relates to flock transfers, and in particular, to a flock transfer which may be stretched.

Flock transfers include a flocking which is secured to a hot melt surface. The flocking is secured to the hot melt, for example, by the method disclosed in my U.S. Pat. No. 4,810,549. The transfer is secured to a textile, such as an shirt, or other item of clothing, by applying heat to the transfer, as is well known. The hot melt used is not elastic—it cannot be stretched. Thus, when the transfer is applied to a stretchable item, such as the leg of a sock, the transfer will crack and split. This can make the transfer unsightly, and is obviously undesirable.

Some prior art patents showing laminated materials, labels, and adhesives are shown in U.S. Pat. Nos. 4,423,106, 4,405,401, and 4,269,885.

SUMMARY OF THE INVENTION

One object of the present invention is to provide a transfer which is stretchable and may be applied to clothing which will stretch the transfer without cracking or splitting the transfer.

Another object is to provide a hot melt, to which transfer flocking is applied, which is stretchable.

These and other objects will become apparent to those skilled in the art in light of the following description and accompanying drawings.

In accordance with the invention, briefly stated, a stretchable hot melt is provided for use with a transfer to apply the transfer to a substrate which may stretch, so that the transfer may stretch with the substrate. The hot melt comprises polyester and urethane in a ratio which allows the hot melt to stretch with the substrate, when the substrate is stretched. The ratio of polyester and urethane in the hot melt is 20:80 to 80:20, and preferably 1:1.

The hot melt is formed by making a mixture of various resins, such as, for example, a mixture of polyester resin and urethane in the appropriate ratio and forming the hot melt, for example by co-extrusion, from the polyester resin-urethane mixture. The polyester resin-urethane mixture is made by combining polyester pellets and urethane pellets and crushing, pulverizing, or shattering the pellets to a powder. Preferably, the pellets are cooled to between −100° C. and −240° C. prior to pulverizing, and the pulverizing step is performed in a cooled crushing device.

DESCRIPTION OF THE PREFERRED EMBODIMENT

Figure 1:
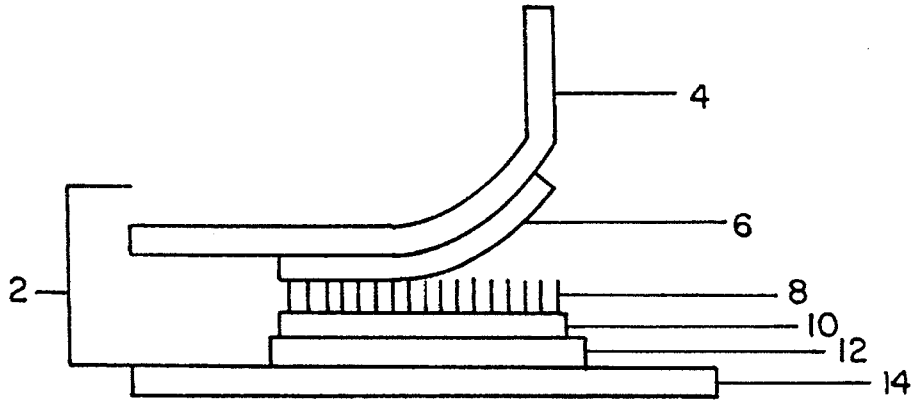
FIG. 1 is a cross sectional view of a flocking transfer of the present invention.

A transfer 2 is shown in the drawing. Transfer 2 includes a dimensionally stable paper sheet 4 to which a conventional flock transfer release adhesive 6, usually a silicon wax, is applied. Flock 8, which may be rayon or any other type of conductive material, such as nylon, polyester, etc., is applied to the activated adhesive 6 by conventional electrostatic means or gravity. The manner of securing the flock 8 to the adhesive 6 is described in my U.S. Pat. No. 4,810,549, which is incorporated herein by reference. The flock 8 is coated with a binder adhesive 10, such as a water based acrylic which binds the flock into a unit. The binder 10 may contain an additional adhesive or hot melt, for binding the transfer to a substrate 14, such as an item of clothing. Alternatively, a hot melt layer 12 may be applied to the binder 10. The use of a separate hot melt layer is preferred.

The hot melt layer often is a polyester or nylon. The polyester or nylon hot melt, however, has not been able to withstand stretching well. I have found that if the hot melt layer 12 is made of a polyester resin and a thermoplastic urethane, the hot melt layer, and hence the transfer, can withstand stretching after the transfer has been applied to a substrate. The urethane preferably has a low melting point and a high viscosity. The ratio of the polyester resin to urethane in the hot melt is between 80:20 and 20:80, and is preferably 1:1 or 50% polyester and 50% urethane.

The polyester resin and urethane resin are typically provided in the form of pellets. To make the hot melt layer, the urethane pellets are added to the polyester pellets, or vice versa, in the proper ratio. The pellets are placed in a pre-cooler to cool the pellets to between −100° C. and −240° C. The cooled pellets are then placed in a hammer-mill, which is preferably cooled, where the hammer-mill is operated to shatter the pellets into powder. A screen is used to control the size of the exiting particles. Preferably, the pellets are shattered and crushed to a size of 200–300 microns.

By combining the pellets and then crushing them, the polyester and urethane will be well intermixed. The polyester resin-urethane powder is then melted and co-extruded to form the hot melt. The co-extruded hot melt can then be applied to the binder layer 10, to secure the flock 8 as a unit.

Figure 2:
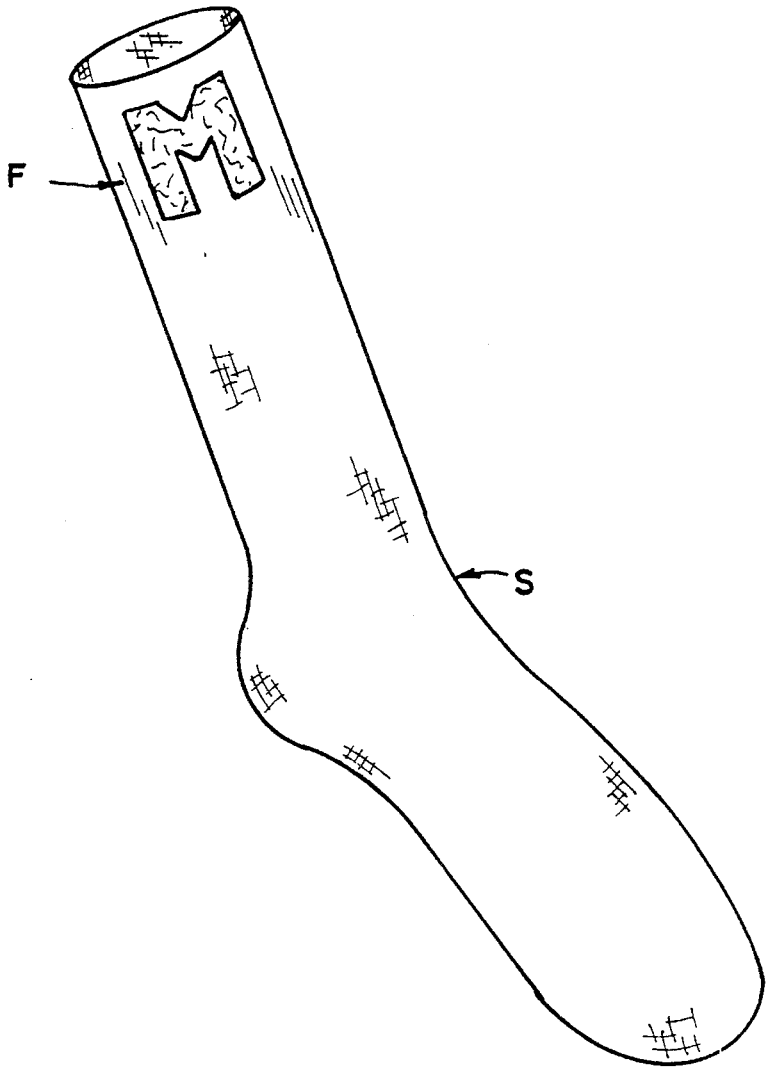
FIG. 2 shows the application of such a transfer to a strechable item of clothing, such as a sock.

FIG. 2 discloses the application of elastomeric backing for flock transfer, and the constructed flock transfer in general, to a stretchable item of clothing, such as a sock. As is readily known, when an item of clothing of this type is applied upon the foot, it stretches significantly, as that portion of the sock bearing the flock passes the wider part of the foot, for movement and locating up upon the ankle. Hence, under normal conditions, when the standard type of flock is used, eventually, they crack, and after repeated washings, deteriorate significantly. But, through the usage of an elastomeric type of adhesive backing for the flock, the adhesive holding the flock has stretchability, along with the sock, and therefore, once the sock reaches steady state, the flock re-establishes its original size, and remains integral and attractive in its appearance.

Variations within the scope of the appended claims may be apparent to those skilled in the art in light of the foregoing disclosure and accompanying drawing. Different plastics could be used in place of the polyester and resin. For example, the various pellets of polymer or resin could be melted or blended together, and extruded as a blended pellet which may then be pulverized into the consistency of a powder, for use as previously stated. In addition, two different powders of the various resins, whether they be polyester, and urethane, could be blended together, into a mixture for usage for purposes of this invention. The method of forming the hot melt from the polyester resin-urethane mixture can be varied. The method of making the mixture can also be varied. For example, the pellets, can be melted together and the hot melt can be formed from the mixture resulting therefrom. Alternatively, the polyester resin-urethane powder can be formed into pellets which are later co-extruded or otherwise formed into hot melt sheets. These variations are merely illustrative.

We claim:

1. A stretchable flock transfer for use for application to a shirt, sock or stretchable clothing, said stretchable flock being of the type capable of stretching with the stretchable clothing when used, comprising:

a base sheet having a surface area coated with a release adhesive;

a flock adhered to the surface area in a desired pattern;

a binding adhesive of a water based acrylic applied to said flock;

a hot-melt adhesive applied to the binding adhesive and which also adheres said transfer to a shirt, sock or stretchable clothing such that said transfer may stretch if the clothing is stretched;

said hot-melt comprising a blend of polyester and thermoplastic urethane, the ratio of polyester and thermoplastic urethane in said hot-melt is 80:20 to 20:80.

2. The flock transfer of claim 1 wherein said ratio of polyester and urethane in said hot melt is 1:1.

* * * * *